US005137464A

United States Patent [19]

Maue et al.

[11] Patent Number: 5,137,464

[45] Date of Patent: Aug. 11, 1992

[54] ELECTRICAL POWER CONNECTOR

[75] Inventors: H. Winston Maue, Farmington Hills; Zenon Hotra, Troy; Vinod T. Patel, Canton, all of Mich.

[73] Assignee: United Technologies Automotive, Inc., Dearborn, Mich.

[21] Appl. No.: 686,202

[22] Filed: Apr. 16, 1991

[51] Int. Cl.[5] ..... H01R 13/703; H01R 13/71

[52] U.S. Cl. ..... 439/188; 200/51.09; 439/364; 439/924

[58] Field of Search ..... 439/188, 186, 187, 362-365, 439/924; 200/51.09

[56] References Cited

U.S. PATENT DOCUMENTS

| | | | |
|---|---|---|---|
| 2,716,737 | 8/1955 | Maberry | 439/181 |
| 3,235,682 | 2/1966 | Papworth | 200/51.09 |
| 3,270,267 | 8/1966 | Nolte, Jr. | 320/56 |
| 3,281,761 | 10/1966 | Moulin | 339/186 |
| 3,599,167 | 8/1971 | Adrian | 200/51.09 |
| 3,771,108 | 11/1973 | Haffner et al. | 339/113 R |
| 3,853,381 | 12/1974 | Morningstar | 339/92 M |
| 3,933,404 | 1/1976 | Oehlerking | 439/911 |
| 4,191,440 | 3/1980 | Schramm | 339/17 C |
| 4,772,081 | 9/1988 | Borgos et al. | 358/96.2 |

FOREIGN PATENT DOCUMENTS

| | | | |
|---|---|---|---|
| 731503 | 4/1980 | U.S.S.R. | 439/188 |

*Primary Examiner*—Neil Abrams
*Attorney, Agent, or Firm*—Ronald G. Cummings

[57] ABSTRACT

An electrical connector assembly having a first connector mounted to a battery cable, a second connector mounted to a load circuit lead, a connector housing with internal contacts for electrically interconnecting the first and second connectors and a turnbuckle assembly for concurrently driving the first and second connectors to automatically disconnect the power side connector from the internal contacts of the housing when disconnecting the second connector from the housing.

13 Claims, 1 Drawing Sheet

ELECTRICAL POWER CONNECTOR

TECHNICAL FIELD

This invention relates to an electrical connector and more particularly to a power connector assembly having particular utility in electric automobiles.

BACKGROUND AND SUMMARY OF THE INVENTION

In certain electrical system applications, connector assemblies are utilized for temporarily disconnecting the power lead from the load circuitry during maintenance, repair, replacement, etc. In high voltage applications such as, for example, in an electric automobile having a battery voltage of 330 volts, it is of course desirable that the connector assembly components do not present any danger of accidental shock when in a disconnected mode.

It is an object of the present invention to provide an electrical power connector assembly which prevents the occurrence of accidental shock from the power side portion of a connector assembly in a disconnected mode.

Another object of the invention is to provide such a connector assembly which also prevents the occurrence of accidental shock from the load side of the connector assembly in a disconnected mode.

A further object of the invention is to provide a power connector assembly which has particular utility for electric automobiles.

A still further object of the invention is to provide a power connector assembly which is cost efficient, durable in use, and convenient to connect and disconnect.

Accordingly, it has been found that the foregoing and related objects are attained in an electrical connector assembly having a first connector adapted for mounting to a power lead, a second connector adapted for mounting to a circuit lead, and a connector housing for mechanically and electrically coupling the first and second connectors. The housing has internal contacts for electrically connecting the first and second connectors and a drive assembly is mounted to the housing for automatically disconnecting the first connector from the internal contacts when disconnecting the second connector from the housing.

In one embodiment, the drive assembly is in the configuration of a turnbuckle assembly for concurrently withdrawing the connectors from electrical connection with the internal housing contacts. In a further embodiment, the second connector has insulated front end contacts for mating engagement with the internal contacts of the housing.

DESCRIPTION OF THE PREFERRED EMBODIMENT

Figure 1:
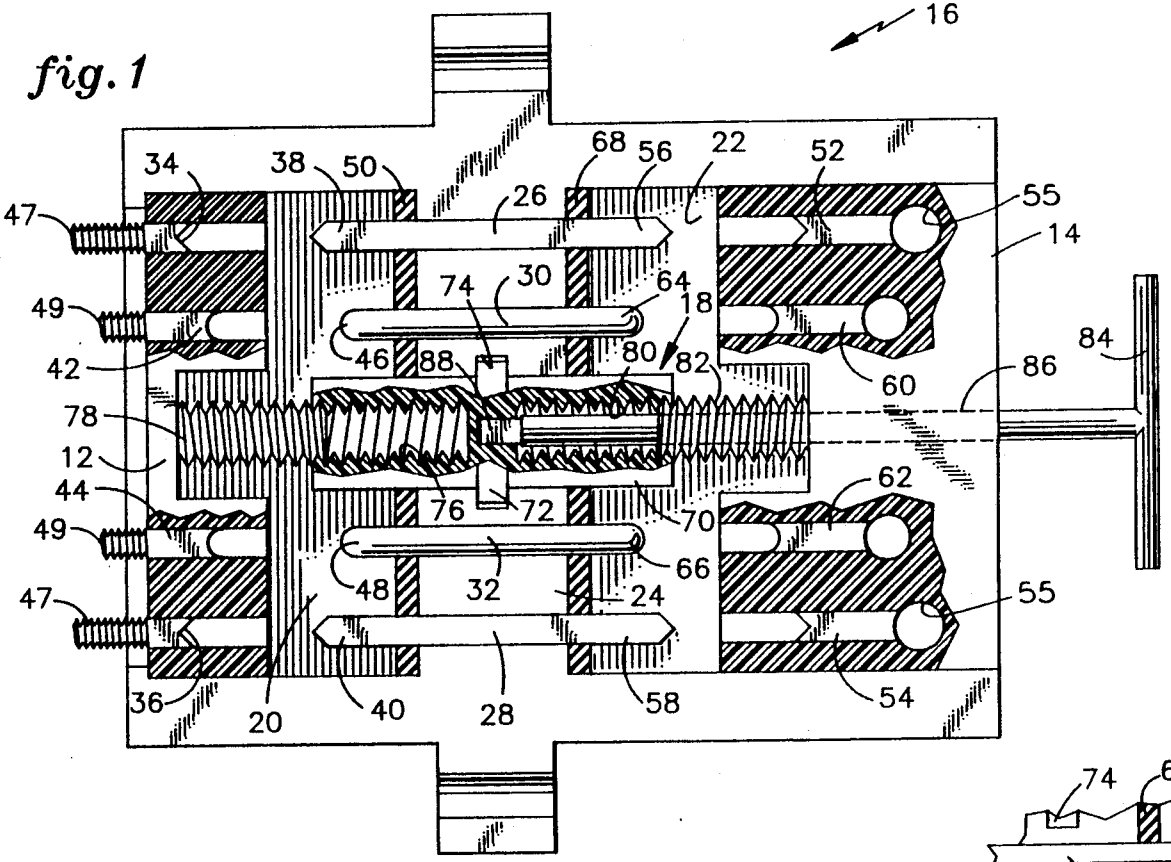
FIG. 1 is a partly broken away diagrammatical view of the connector assembly of the present invention.

Although specific forms of the present invention have been selected for illustration in the drawings, and the following description is drawn in specific terms for the purpose of describing these forms of the invention, the description is not intended to limit the scope of the invention which is defined in the appended claims.

Referring to FIG. 1, the electrical connector assembly of the present invention generally comprises an internal cable connector 12 mounted to a power lead (not shown), an external cable connector 14 mounted to a load circuit lead (not shown), a carrier housing 16 mechanically and electrically coupling the connectors, and a turnbuckle drive assembly 18.

The housing 16 is in the form of a bulkhead mounted connector carrier for securement to a structural support in an electric automobile. The carrier 16 is generally constructed of dielectric material and forms oppositely disposed recesses 20, 22 separated by an internal wall 24. A pair of electrically conductive contact pins 26, 28 extend through the wall 24 between the recesses 20, 22. The pins 26, 28 are generally equi-spaced and parallel to the longitudinal axis of the carrier 16.

A second pair of contact pins configured as pilot contact pins 30, 32 are similarly disposed to extend through the wall 24 between the recesses 20, 22. The pilot contact pins 30, 32 are substantially shorter than the contact pins 26, 28 as noted hereinafter.

The internal cable connector 12 has a pair of female contact members 34, 36 which mate respectively with the ends 38, 40 of the contact pins 26, 28 for a friction-fit connection providing good electrical continuity. The connector 12 also has a pair of female pilot contact members 42, 44 which are similarly configured and disposed for friction-fit engagement with the ends 46, 48 of the pilot contact pins 30, 32 respectively.

The connector 12 is rigidly attached to the terminal end of the battery cable (not shown) such that the battery electrodes are connected to the contact members 34, 36. The outer ends 47 of the contact members 34, 36 are threaded for securing the lugs of the battery cable thereto by threaded fasteners. Similarly, the pilot contact members 42, 44 have threaded outer ends 49 for connecting the pilot leads (not shown). In assembly, the outer ends 47, 49 are enclosed to prevent contact.

The connector 12 is mounted within the recess 20 for reciprocal movement along the longitudinal axis of the carrier 16. The connector 12 is movable between a first position wherein the connector 12 abuts the rubber weather seal 50 adjacent to the wall 24 and the contact pins 26, 28, 30, 32 are electrically connected to the respective connector contact members and a second position axially outwardly therefrom wherein said contact pins are electrically disconnected for the connector contact members. The connector 12 is integrally mounted to the carrier 16 so that, for safety reasons, it cannot be removed from carrier 16.

Similar to the connector 12, the external cable connector 14 has female contact members 52, 54 which mate in friction-fit engagement with the terminal ends 56, 58 of contact pins 26, 28 to provide good electrical continuity. The outer ends 55 of contacts 52, 54 are connected to the orthogonally-disposed conductors of the circuit lead by soldering, crimp connection or the like. Connector 14 also has female pilot contact members 60, 62 to mate with the terminal ends 64, 66 of pilot pin contacts 30, 32 similar to connector 12.

The connector 14 is mounted within the recess 22 for reciprocal movement along the longitudinal axis of the carrier 16 and for easy removal therefrom. The connector 14 is movable between a first position wherein the connector abuts the rubber weather seal 68 adjacent to the wall 24 and the contact pins 26, 28, 30, 32 are electrically connected to the respective connector contact members and a second position removed from the carrier 16. In a conventional manner, the connector 14 is polarized to insure proper polarity when re-inserting the connector 14 into the recess 22.

The turnbuckle drive assembly 18 interconnects the connectors 12, 14 to the carrier 16 for driving the connectors toward and away from the contact pins 26, 28, 30, 32. The turnbuckle assembly 18 has a turnbuckle sleeve 70 extending through wall 24 between the recesses 20, 22 and disposed concentric to the longitudinal axis of carrier 16. The turnbuckle sleeve 70 is rotatably mounted within the wall 24 with an annular shoulder 72 received within a corresponding annular slot 74 in the wall 24 to capture the sleeve 70 and prevent longitudinal displacement.

The sleeve 70 has an internally threaded end section 76 positioned for threaded engagement with an externally threaded stud 78 of connector 12. Similarly, the other end of sleeve 70 has an internally threaded end section 80 for threaded engagement with the externally threaded stud 82 of connector 14. In a conventional manner, the screw connections at each end of the sleeve 70 are of opposite hand (left and right) so that rotation of the sleeve 70 in one direction will draw the connectors 12, 14 together and rotation of sleeve 70 in the opposite direction will draw the connectors 12, 14 apart.

To rotate the sleeve 70, a handle 84 with a hexagonal shaped shaft 86 is connected to the sleeve 70 for manual rotation thereof. The shaft 86 extends through a longitudinal bore in the carrier 14 and the stud 82 into engagement with a hexagonal drive recess 88 in the center wall of sleeve 70. When the shaft 86 is seated within the recess 88, manual rotation of handle 84 will correspondingly rotate the turnbuckle sleeve 70 within the carrier 16.

Referring to FIG. 1, the connectors 12, 14 are shown in an intermediate position in that the connector contact members are electrically disconnected from the carrier contact pins yet the connector 14 is not completely removed from the carrier 16. Starting from the position of FIG. 1 for purposes of explanation, rotation of handle 84 in one direction will draw the connectors 12, 14 axially inwardly until the contact pins are fully inserted into the respective contact members of connectors 12, 14. In this first closed position, the contact members 34, 36, 42, 44 of the internal cable connector 12 are electrically connected to the contact members 52, 54, 60, 62 respectively of the external cable connector 14.

From the closed position, angular rotation of the handle 84 in the opposite direction will concurrently withdraw the connectors 12, 14 axially outwardly from the housing wall 24. The pilot contact pins 30, 32 are shorter than the contact pins 26, 28 and therefore will electrically disconnect from the respective pilot contact members of connectors 12, 14 before contact pins 26, 28 disconnect from the corresponding contact members of connectors 12, 14. The handle 84 is rotated until the external connector 14 is removed from the carrier 16. During withdrawal of connector 14 from the carrier, the connector 12 is automatically disconnected from the contact pins so that after removal of connector 14, the exposed ends 56, 58 of contact pins 26, 28 in recess 22 do not present a danger from accidental electrical shock. Since the contact pins 26, 28 are disconnected from the power side connector 12, there is no voltage potential across these contact pins and consequently there is no danger of accidental electrical shock.

The pilot contact pins and contact members function to prevent the electrical loads in the load circuitry from being activated or deactivated before the external cable connector 14 is mechanically engaged or disengaged with the carrier 16. Relative to the load contact pins 26, 28, the pilot contact pins 30, 32 electrically disconnect from their respective connector contact members prior to the electrical disconnection of the load contact pins as the connector 14 is being withdrawn. Conversely, when the connectors 12, 14 are being driven inwardly, the pilot contact pins engage the corresponding pilot contact members after electrical connection of the load contact pins. Typically, the pilot contact members are interconnected to a controller, such as a relay and power will not be connected or disconnected under electrical load. Thus, a pilot circuit operation is achieved.

The relative displacement of the connectors 12, 14 responsive to angular rotation of the handle 84 can be varied by changing the ratio and pitch of the threaded studs 78, 82 and sleeve 70. Other types of drive apparatus such as a lever drive, a gear drive, etc. may be utilized for automatically disconnecting the connector 12 from the contact pins prior to removal of the connector 14 from the carrier 16. The relative orientation of the connectors 12, 14 may be varied to accommodate other types of drive assemblies and the number of contact pins may be varied to accommodate the particular application.

Figure 2:
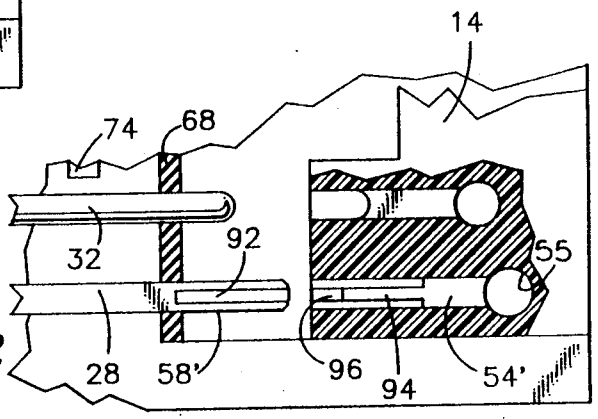
FIG. 2 is a broken away view showing the mating pin and contact member of an alternate embodiment.

Referring to FIG. 2, an alternate contact pin/mating contact member assembly is shown in the form of a dead-end connector to guard against back fed voltage from the load circuit when the connector 14 is removed from the carrier 16.

In this embodiment, the end 58' of contact pin 28 has a longitudinal cylindrical recess 92 to receive the shank portion 94 of contact member 54'. The outer end 96 of the shank portion 94 comprises insulating material and is configured to be in close axial proximity to the insulating body of connector 14 so as to prevent finger contact with the electrically conductive shank portion 94. Although not shown in FIG. 2, it is to be understood that the upper contact pin 26 and corresponding contact member are similarly configured.

As can be seen, an electrical power connector assembly has been described which automatically disconnects the power side connector from the internal contact of the connector carrier when removing the load side connector to prevent the occurrence of accidental shock therefrom. Moreover, the present connector prevents the occurrence of accidental shock in both the power side portion and the load side portion of the connector assembly in a disconnected mode. Such a connector assembly is particularly suited for electrical automobiles providing safe and convenient connection and disconnection of high power leads.

Although the illustrated embodiment is in the form of a battery cable connector assembly for electric automobiles, it is to be understood that the present invention is not limited to electric automobiles and may be utilized in a variety of power applications. As will be apparent to persons skilled in the art, various modifications and adaptation of the structure above described will become readily apparent without departure from the spirit and scope of the invention, the scope of which is defined in the appended claims.

What is claimed is:

1. An electrical connector assembly comprising:

a first connector adapted for mounting to a power lead, a second connector adapted for mounting to a circuit lead, a connector housing means for mechanically and electrically coupling said first and second connectors, said housing comprising contact means for electrically interconnecting said first and second connectors to connect the power lead to the circuit lead, and means for automatically disconnecting said first connector from said contact means when disconnecting said second connector from said housing means, said disconnecting means comprising mechanical drive means connected to the first and second connectors for driving the first and second connectors from said contact means responsive to mechanical actuation.

2. The device of claim 1 wherein said first and second connectors are configured for friction-fit engagement with said contact means, said first and second connectors are each adapted for movement between first and second positions with said first and second connectors being in friction-fit engagement with said contact means in said first position and disengaged from said contact means in said second position, and said driving means comprises means for coordinately driving said first and second connectors to said second position.

3. The device of claim 1 wherein said driving means comprises a threaded drive assembly interconnected to said first and second connectors for driving said connectors from said contact means responsive to angular rotation.

4. The device of claim 1 wherein said driving means comprises means for substantially concurrently withdrawing said first and second connectors from electrical connection with said contact means.

5. The device of claim 1 wherein said contact means comprises a contact pin having first and second ends with said first end configured to engage a mating contact element in said first connector and said second end configured to engage a mating contact element in said second connector, said first and second connectors each having a mating contact element, said housing means comprises a carrier having a recess to mount said second connector, said second connector being movable between a first position with its contact element engaging said second end of said contact pin and a second position with said contact element electrically disconnected from said contact pin, said first connector being movably mounted to said carrier for movement between a first position with its contact element engaging said first end of said contact pin and a second position with said contact element electrically disconnected from said contact pin, and said driving means comprises means for concurrently driving said first and second connectors toward said second position.

6. The device of claim 5 wherein said contact means comprises a second contact pin being a pilot contact pin and having first and second ends with said first end configured to engage a second mating pilot contact element in said first connector and said second end configured to engage a second mating pilot contact element in said second connector, said first and second connectors each having a second mating pilot contact element, said pilot contact pin and said second mating elements being disposed such that said pilot contact pin engages said second contact elements when said connectors are in said first position and said pilot contact pin is electrically disconnected from one of said second contact elements when said connectors are at an intermediate position between said first and second positions.

7. The device of claim 1 wherein said contact means comprises a pair of contact pins, each having first and second ends with said first end configured to engage a respective mating contact element in said first connector and said second end configured to engage a respective mating contact element in said second connector, said first and second connectors each having a pair of mating contact elements, said housing means comprises a carrier having a recess to mount said second connector, said second connector being movable between a first position with its contact elements engaging said respective second ends of said contact pins and a second position with said contact elements electrically disconnected from said contact pins, said first connector being movably mounted to said carrier for movement between a first position with its contact elements each engaging said respective first ends of said contact pins and a second position with said contact elements electrically disconnected from said contact pins, and said driving means comprises means for concurrently driving said first and second connectors toward said second position.

8. The device of claim 7 wherein said pair of mating contact elements of said second connector are dead end type contact elements.

9. The device of claim 1 wherein said housing means comprises second contact means for electrically interconnecting said first and second connectors to connect a pilot input lead to a pilot output lead, and said disconnecting means comprises means for automatically disconnecting said second contact means from one of said first connector and said second connector prior to disconnecting said first connector from said first contact means.

10. The device of claim 1 wherein said contact means comprises a contact pin having first and second ends with said first end configured to engage a mating contact element in said first connector and said second end configured to engage a mating contact element in said second connector, said first and second connectors each having a mating contact element with said mating contact element of said second connector being a dead end type contact element.

11. An electrical connector assembly comprising:

a first connector adapted for mounting to a power lead, a second connector adapted for mounting to a circuit lead, a connector housing means for mechanically and electrically coupling said first and second connectors, said housing comprising contact means for electrically interconnecting said first and second connectors to connect the power lead to the circuit lead, means for automatically disconnecting said first connector from said contact means when disconnecting said second connector from said housing means, and said disconnecting means comprising a turnbuckle assembly mechanically connecting said first and second connectors to said housing means for substantially concurrently withdrawing said first and second connectors from electrical connection with said contact means.

12. An electrical connector assembly comprising:

a first connector adapted for mounting to a power lead, a second connector adapted for mounting to a circuit lead, a connector housing means for mechanically and electrically coupling said first and second connectors, said housing comprising contact means for electrically interconnecting said first and second connectors to connect the power lead to the circuit lead, means for automatically disconnecting said first connector from said contact means when disconnecting said second connector from said housing means, .

said contact means comprising a contact pin having first and second ends with said first end configured to engage a mating contact element in said first connector and said second end configured to engage a mating contact element in said second connector, said first and second connectors each having a mating contact element, said housing means comprising a carrier having a recess to mount said second connector, said second connector being movable between a first position with its contact element engaging said second end of said contact pin and a second position with said contact element electrically disconnected from said contact pin, said first connector being movably mounted to said carrier for movement between a first position with its contact element engaging said first end of said contact pin and a second position with said contact element electrically disconnected from said contact pin, said first and second connectors being oppositely disposed to move along an axis toward and away from each other with said contact pin therebetween, said disconnecting means comprises means for concurrently driving said first and second connectors toward said second position having a turnbuckle sleeve rotatably mounted to said carrier and having opposite ends carrying opposite-hand threads, a first stud mounted to said first connector having threads engaging one end of said sleeve, and a second stud mounted to said second connector having threads engaging the other end of said sleeve such that rotation of said sleeve in one direction drives said connectors towards each other and rotation of said sleeve in the other direction drives said connectors away from each other.

13. An electrical connector assembly comprising:

a first connector adapted for mounting to a power lead, a second connector adapted for mounting to a circuit lead, a connector housing means for mechanically and electrically coupling said first and second connectors, said housing comprising contact means for electrically interconnecting said first and second connector to connect the power lead to the circuit lead, means for automatically disconnecting said first connector from said contact means when disconnecting said second connector from said housing means, said contact means comprising a pair of contact pins, each having first and second ends with said first end configured to engage a respective mating contact element in said first connector and said second end configured to engage a respective mating contact element in said second connector, said first and second connectors each having a pair of mating contact elements, said housing means comprising a carrier having a recess to mount said second connector, said second connector being movable between a first position with its contact elements engaging said respective second ends of said contact pins and a second position with said contact elements electrically disconnected from said contact pins, said first connector being movably mounted to said carrier for movement between a first position with its contact elements each engaging said respective first ends of said contact pins and a second position with said contact elements electrically disconnected from said contact pins, said first and second connectors being oppositely disposed to move along an axis toward and away from each other with said contact pins therebetween, said disconnecting means comprising means for concurrently driving said first and second connectors toward said second position having a turnbuckle sleeve rotatably mounted to said carrier and having opposite ends carrying opposite-hand threads, a first stud mounted to said first connector having threads engaging one end of said sleeve, a second stud mounted to said second connector having threads engaging the other end of said sleeve such that rotation of said sleeve in on direction drives said connectors towards each other and rotation of said sleeve in the other direction drives said connectors away from each other, and a handle operationally connected to said sleeve for manually rotating said sleeve.

* * * * *